US011466830B1

(12) United States Patent
Zheng

(10) Patent No.: US 11,466,830 B1
(45) Date of Patent: Oct. 11, 2022

(54) LED SIMULATED FLAME DEVICE AND LED SIMULATED CANDLE

(71) Applicant: Dongguan Jingmao Electronic Technology Co., Ltd., Dongguan (CN)

(72) Inventor: Jianfeng Zheng, Dongguan (CN)

( * ) Notice: Subject to any disclaimer, the term of this patent is extended or adjusted under 35 U.S.C. 154(b) by 0 days.

(21) Appl. No.: 17/647,977

(22) Filed: Jan. 13, 2022

(30) Foreign Application Priority Data

Nov. 22, 2021 (CN) ..... 202111388968.2

(51) Int. Cl.

| | |
|---|---|
| ***F21S 10/04*** | (2006.01) |
| ***F21V 23/00*** | (2015.01) |
| ***F21S 9/02*** | (2006.01) |
| ***F21V 3/02*** | (2006.01) |
| *F21Y 115/10* | (2016.01) |

(52) U.S. Cl.
CPC ..... *F21S 10/046* (2013.01); *F21S 9/02* (2013.01); *F21V 3/02* (2013.01); *F21V 23/004* (2013.01); *F21Y 2115/10* (2016.08)

(58) Field of Classification Search
CPC ..... F21S 10/04; F21S 10/043; F21S 10/046; F21V 3/02
See application file for complete search history.

(56) References Cited

U.S. PATENT DOCUMENTS

| | | | | |
|---|---|---|---|---|
| 4,510,556 | A * | 4/1985 | Johnson | H05B 39/09 362/802 |
| 10,161,583 | B1 * | 12/2018 | Stobart | F21S 9/037 |
| 10,344,930 | B1 * | 7/2019 | Mitchell, Jr. | F21K 9/23 |
| 10,352,515 | B1 * | 7/2019 | Yin | F21S 6/001 |
| 10,900,627 | B1 * | 1/2021 | Cullimore | F21V 23/009 |
| 2004/0223326 | A1 * | 11/2004 | Wainwright | H05B 45/30 362/249.06 |
| 2006/0131596 | A1 * | 6/2006 | Ouderkirk | H01L 33/60 257/E33.072 |
| 2008/0130266 | A1 * | 6/2008 | DeWitt | A61L 9/12 422/123 |
| 2019/0383454 | A1 * | 12/2019 | Fan | H05B 45/60 |
| 2020/0393102 | A1 * | 12/2020 | Huang | F21V 23/004 |

FOREIGN PATENT DOCUMENTS

| | | |
|---|---|---|
| CN | 104279497 B | 9/2016 |
| CN | 210532281 U | 5/2020 |
| CN | 106090819 B | 7/2020 |

* cited by examiner

*Primary Examiner* — Bryon T Gyllstrom
*Assistant Examiner* — Christopher E Dunay

(57) ABSTRACT

An LED simulated flame device includes a semi-transparent diffusion cover in a candle flame shape, a light-emitting lamp plate, and a control circuit module. The light-emitting lamp plate includes a PCB substrate, and several LED chips shading between brightness and darkness at random, and the LED chips include an up-lighting LED chip that is located on a top edge of the PCB substrate, emits light upward, and is configured to project light and shadows onto a middle upper portion of the diffusion cover, two mid-lighting LED chips that emit light toward a front surface of the diffusion cover, are configured to project light and shadows onto a middle portion of the diffusion cover, and are located on front and back surfaces of the PCB substrate, and a down-lighting LED chip that corresponds to a bottom portion of the diffusion cover, emits light upward, and is configured to supplement light.

15 Claims, 5 Drawing Sheets

LED SIMULATED FLAME DEVICE AND LED SIMULATED CANDLE

This application is based upon and claims priority to Chinese Patent Application No. 202111388968.2, filed on Nov. 22, 2021, the entire contents of which are incorporated herein by reference.

TECHNICAL FIELD

The present invention relates to the field of simulated flame technologies, and specifically, to a light-emitting diode (LED) simulated flame device and an LED simulated candle.

BACKGROUND

Candles, oil lamps, alcohol lamps, or the like generate flames by fuels burning through a wick, having both illumination and decorative functions. Since the flickering flames thereof can create a soothing and warm atmosphere, these lighting items are widely used in scenarios such as hotels, churches, and homes. Moreover, electronic simulated flames can be used in products such as simulated candles, simulated lanterns, or simulated alcohol lamp stoves instead of real flames due to higher security.

In the related art, the most common form of a simulated flame is to project light onto a swaying flame sheet to simulate the effect of a dynamic flame. For example, the Chinese Patent No. CN106090819B discloses a flame sheet swing mechanism and an electronic candle, in which the core structural principle is to drive a flame sheet to sway using a magnetic field generation mechanism, so that the flame sheet has a realistic effect of flickering candlelight under the illumination of light. For this electronic candle, only the front of the flame sheet projected by the light has a relatively realistic simulated effect, while the back and sides thereof need to be covered up. Light reflected by the flame sheet only has a decorative effect, and hardly has an illumination function due to a quite low brightness. The magnetic field generation mechanism needs to be disposed, a space for the flame sheet to sway needs to be provided, and a light source for projecting light also needs to be disposed, leading to a structure with a relatively large diameter and limited applicable products. For example, a product such as a small-diameter simulated candle cannot be made. In addition, when the flame sheet is controlled to sway in an electromagnetic control manner, energy consumption is relatively high, service time is limited, and product costs are relatively high.

In the related art, a second form of a simulated flame adopts a manner similar to dynamic display using a display screen. For example, the Chinese Patent No. CN104279497B discloses a bulb that simulates a real flame to shine, in which the structural principle is to arrange a plurality of LED chips in a matrix on a printed circuit board (PCB) substrate to form a display surface, to simulate a dynamic effect of burning flames. The simulated flame of this structure has relatively rich dynamic effects. However, the plurality of LED chips arranged densely in a matrix are needed to form the display surface. Consequently, the simulated flame has a relatively large spatial size, relatively high costs, and relatively high energy consumption, and thus cannot be used to simulate a candle flame form with a quite limited space.

In the related art, a third form of a simulated flame is to use several LED lamps in a flickering manner to simulate the effect of candle flames. For example, the Chinese Patent No. CN210532281U discloses a simulated electronic candle, including a flame LED light source mounted in a simulated flame, where the flame LED light source includes a light-transmitting substrate (a transparent or semi-transparent substrate made of epoxy resin), a column of LED lamp group is disposed on the light-transmitting substrate, and an upper portion and a lower portion of the LED lamp group are LEDs of different colors. For example, the upper portion is 4 warm light LEDs configured to simulate an outer flame, the lower portion is 1 or 2 blue light LEDs configured to simulate a flame core, and light of the warm light LEDs and the blue light LEDs merges to form a weaker inner flame. This simulated electronic candle can make light of different colors merge and change from time to time or flash alternately, providing more vivid and dazzling color changes. However, the electronic candle has the following problems: 1. When epoxy resin is made into a PCB substrate, a material such as a fiberglass cloth needs to be added, which is difficult to be made into the light-transmitting substrate theoretically. In addition, for the column of LED lamp group located on the light-transmitting substrate, light is emitted from one side of the light-transmitting substrate while the brightness of the other side only depends on the reflection and refraction of light. Consequently, light on one side of the light-transmitting substrate is excessively strong while light on the other side is weaker. Moreover, the darker side cannot simulate the light and shadow level and the dynamic burning effects of real flames. 2. The upper portion and the lower portion use the plurality of LEDs to simulate the effect of flames, to make the light of different colors merge and change or flash alternately. However, since the quantity of LEDs is relatively large, the light and shadow effect simulated when the LEDs flicker is a disordered flashing effect rather than a soothingly changing form of real candle flames during burning, resulting in a poor dynamic simulated effect of burning flames. 3. The column of LED light group emits light toward one side of the substrate. As a result, light on the front is excessively strong and a fluorescent coating needs to be coated to soften the light, leading to a complex process and high costs. In conclusion, in the related art, when several LED lamps in a flickering manner are used to simulate a burning effect of a candle flame, due to a limited space inside the candle flame and the blocking of a PCB substrate, it is difficult for a simulated flame to simulate a complete flame form at 360 degrees and close to the light and shadow level and dynamic burning effects of real candle flames during burning.

SUMMARY

In view of the disadvantages in the related art, an objective of this application is to provide an LED simulated flame device that can simulate a complete candle flame form and has the light and shadow level and dynamic burning effects of candle flames during burning, and that has low costs, low energy consumption, and a small size, and an LED simulated candle.

To achieve the foregoing objective, the following technical solutions are used in the present invention.

An LED simulated flame device is provided, including: a semi-transparent diffusion cover in a candle flame shape and having an accommodating cavity, a light-emitting lamp plate vertically inserted in the accommodating cavity, and a control circuit module for driving the light-emitting lamp plate to work, where the light-emitting lamp plate includes a PCB substrate, and several LED chips disposed on the PCB substrate and shading between brightness and darkness at random, and specifically, the LED chips include an up-lighting LED chip that is located on a top edge of the PCB substrate, emits light upward, and is configured to project light and shadows onto a middle upper portion of the diffusion cover, two mid-lighting LED chips that emit light toward a front surface of the diffusion cover, are configured to project light and shadows onto a middle portion of the diffusion cover, and are located on front and back surfaces of the PCB substrate, and at least one down-lighting LED chip that corresponds to a bottom portion of the diffusion cover, emits light upward, and is configured to supplement light, where a section of the PCB substrate corresponding to the mid-lighting LED chips is a narrow-edge section with a gap from an inner wall of the diffusion cover to reduce light shading.

An LED simulated candle is provided, including the foregoing LED simulated flame device, and further including a hollow simulated wax tube, and a battery holder mounted on the simulated wax tube and configured to mount a battery, where the battery holder is electrically connected to a PCB substrate.

Beneficial effects of this solution are as follows: 1. Light and shadows of the up-lighting LED chip are used for simulating an outer flame of a flame. The up-lighting LED chip is disposed on the top edge of the PCB substrate and emits light upward. In this way, an entire upper portion of the diffusion cover can be lit up by only one LED chip. Compared with a manner in the related art in which one front-lighting LED chip is provided respectively on both sides of a PCB substrate, the quantity of LED chips is reduced, no dark shadow appears at the top of the flame, and light of the outer flame is soft rather than dazzling. The two mid-lighting LED chips are configured to simulate an inner flame, and are respectively disposed on the front and back surfaces of the PCB substrate and emit light toward the front surface of the diffusion cover. In this way, light and shadows have a relatively large projection area, thereby preventing an obvious light and shadow break from appearing on the diffusion cover. In addition, an illumination level of the simulated flame can be ensured, so that the simulated flame has both decorative and illumination functions. The down-lighting LED chip is configured to simulate a flame core and emits light upward, which not only softens the light of the flame core, but also supplements light and shadows of a region that cannot be illuminated by the mid-lighting LED chips. In addition, there is the gap between the PCB substrate of the narrow-edge section and the inner wall of the diffusion cover, which can not only avoid dark shadows on both sides of the diffusion cover caused by light and shadows of the down-lighting LED chip blocked by the both sides of the PCB substrate, but also reduce blocking of diffused light in the diffusion cover by the PCB substrate as much as possible and make light inside the diffusion cover more uniform. The light-emitting lamp plate enables an entire periphery of the diffusion cover to simulate the light and shadow effect of flames. 2. An illumination level of the mid-lighting LED chip is different from that of the up-lighting LED chip and that of the down-lighting LED chip. In addition, each LED chip shades between brightness and darkness at random, which makes light and shadows at junctions change up and down, thereby simulating the dynamic effect of soft up-and-down waving of the inner flame part. The two mid-lighting LED chips asynchronously shade between brightness and darkness, which can further simulate the dynamic effect of soft horizontal waving of the inner flame part, thereby simulating the dynamic effect of soothingly changing candle flames during burning. Compared with a manner of flickering lighting in the related art, the dynamic simulated effect is better. 3. The semi-transparent diffusion cover can scatter and soften internal light, which can not only make light and shadows of the simulated flame more saturated and more uniform, and thus make light soft rather than dazzling, but also prevent an obvious bright spot from appearing at the position of each LED chip. 4. A small quantity of LED chips can be used to simulate a complete flame form that is close to the light and shadow level and dynamic burning effects of real flames, and has both decorative and illumination functions with low costs, low energy consumption, and a small volume. A smallest width of the accommodating cavity only needs to allow accommodation of a horizontal LED chip. Compared with the structure of a swaying flame sheet in the related art, the simulated flame device can be made into a quite small volume, and thus is applicable to most products with a simulated flame, for example, being made into a small and thin candle.

BRIEF DESCRIPTION OF THE DRAWINGS

The following further describes in detail the present invention with reference to the accompanying drawings and specific embodiments.

DETAILED DESCRIPTION OF THE EMBODIMENTS

Figure 1:
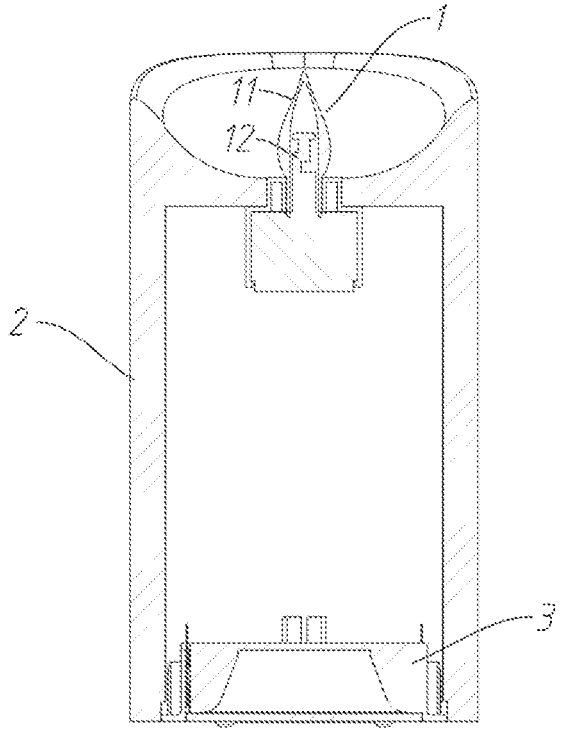
FIG. 1 is a schematic cross-sectional view of a structure of an LED simulated candle according to an embodiment.
Figure 2:
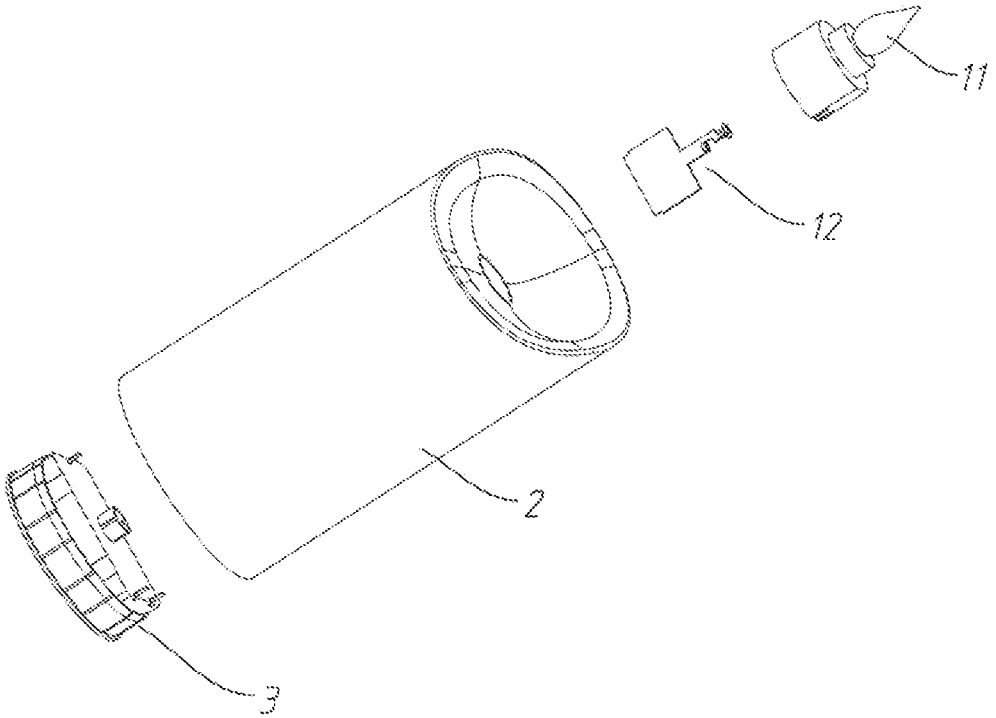
FIG. 2 is a schematic diagram of a part decomposition structure of an LED simulated candle according to an embodiment.
Figure 3:
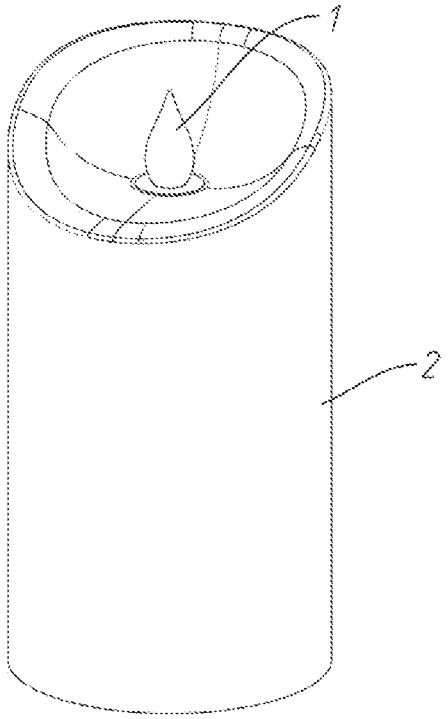
FIG. 3 is a schematic diagram of an overall shape structure of an LED simulated candle according to an embodiment.

The following further describes the present invention with reference to the accompanying drawings:

Referring to FIG. 1 to FIG. 3, this embodiment takes an LED simulated candle for description. The LED simulated candle includes an LED simulated flame device 1, and a hollow simulated wax tube 2, and a battery holder 3 mounted on the simulated wax tube 2 and configured to mount a battery, where the simulated flame device 1 is embeddedly fixed at a top end of the simulated wax tube 2, the battery holder 3 is fixed at a bottom end of the simulated wax tube 2, and the battery holder 3 is electrically connected to the LED simulated flame device 1. In another embodiment, the simulated wax tube 2 may be changed into a shape of cup wax, lantern, or alcohol lamp stove, to form different forms of products with a simulated flame, but the basic structural principle of the simulated flame device 1 thereof is the same.

Figure 4:
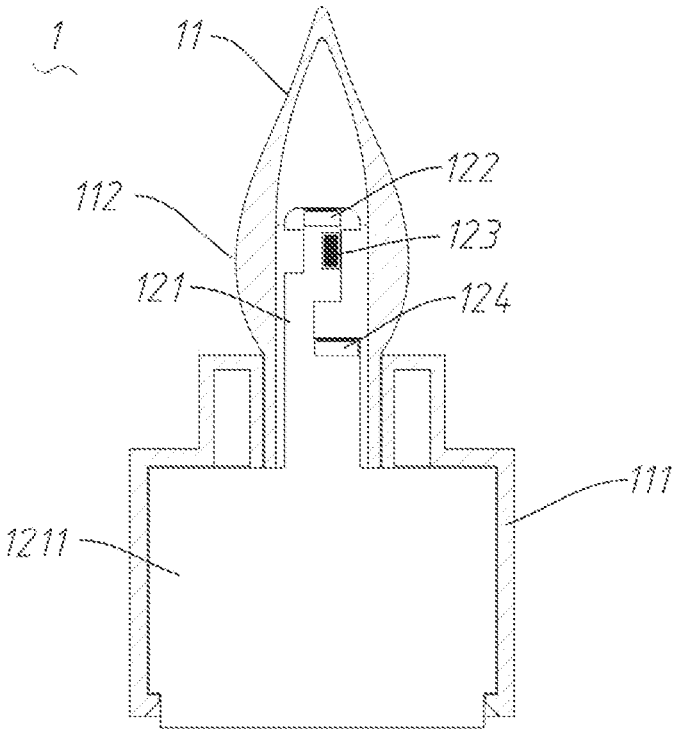
FIG. 4 is a schematic diagram of an internal structure of an LED simulated flame device according to an embodiment.
Figure 5:
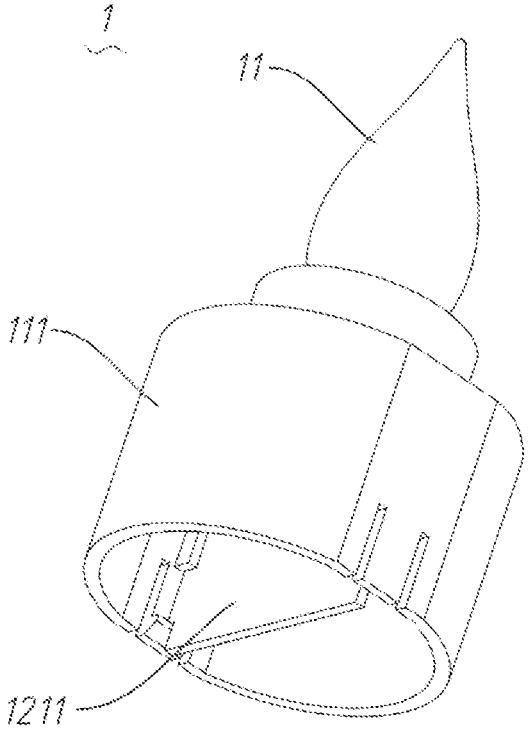
FIG. 5 is a schematic diagram of an overall structure of an LED simulated flame device according to an embodiment.

Referring to FIG. 2, FIG. 4, and FIG. 5, the LED simulated flame device 1 includes a semi-transparent diffusion cover 11 in a candle flame shape and having an accommodating cavity, a light-emitting lamp plate 12 vertically inserted in the accommodating cavity, and a control circuit module for driving the light-emitting lamp plate 12 to work. The light-emitting lamp plate 12 includes a PCB substrate 121, and several LED chips disposed on the PCB substrate 121 and driven by the control circuit module to shade between brightness and darkness at random. Specifically, the LED chips include an up-lighting LED chip 122 that is located on a top edge of the PCB substrate 121, emits light upward, and is configured to project light and shadows onto a middle upper portion of the diffusion cover 11, two mid-lighting LED chips 123 that emit light toward a front surface of the diffusion cover 11, are configured to project light and shadows onto a middle portion of the diffusion cover 11, and are located on front and back surfaces of the PCB substrate 121, and at least one down-lighting LED chip 124 that corresponds to a bottom portion of the diffusion cover 11, emits light upward, and is configured to supplement light, where a section of the PCB substrate 121 corresponding to the mid-lighting LED chips 123 is a narrow-edge section 1213 with a gap from an inner wall of the diffusion cover 11 to reduce light shading. That each LED chip shades between brightness and darkness at random refers to that each LED chip shades between brightness and darkness irregularly according to a configuration under the drive of the control circuit module. Specifically, each LED chip is relatively independent and synchronously or asynchronously shades between brightness and darkness at random. A period of brightness and darkness changes of a single LED chip and upper and lower limit values of brightness within each change period also change at random. However, changes in the brightness of the LED chips are gradual rather than abrupt.

A bottom end of the diffusion cover 11 is further provided with a concentric base 111, where the base 111 has a cavity in communication with the accommodating cavity, the PCB substrate 121 is further provided with an extension plate 1211 fixed in the cavity of the base 111, and the control circuit module is disposed on the extension plate 1211. In another embodiment, the control circuit module may alternatively be disposed on a separate PCB plate, and the PCB plate may be adjacent to the PCB substrate 121, or may be disposed close to the battery holder 3.

Figure 6:
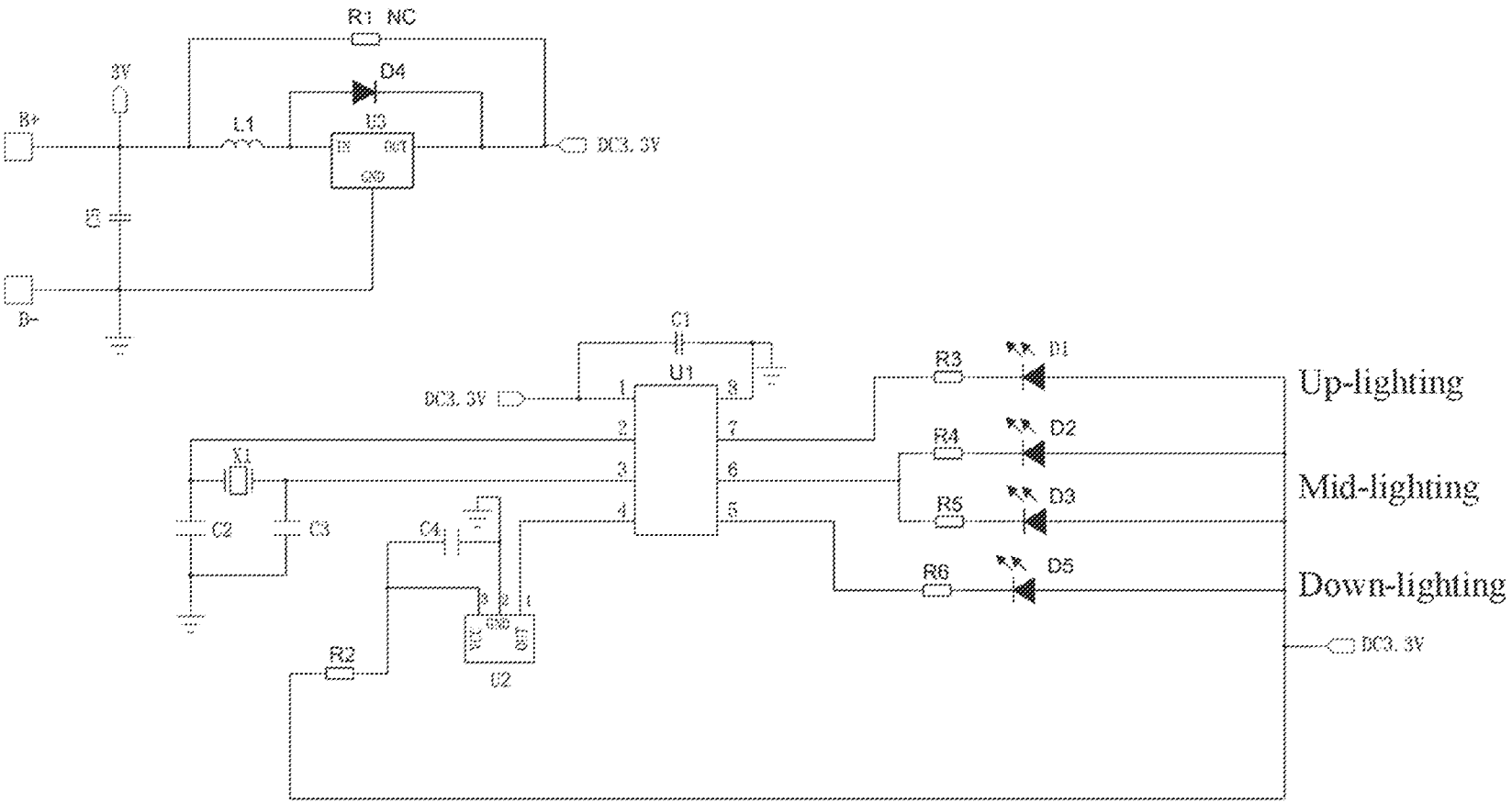
FIG. 6 is a schematic diagram of a circuit of a control circuit module according to an embodiment.

Referring to the schematic diagram of a circuit shown in FIG. 6, in this embodiment, the control circuit module is powered by a battery in the battery holder 3, is boosted to DC 3.3 V by a boost converter, to supply power to a micro control unit (MCU) and each LED chip, and controls each LED chip to shade between brightness and darkness at random through the MCU. A control circuit of each LED chip is the same as that in the related art, and may be implemented through a plurality of solutions, which is not described in detail herein.

Light and shadows of the up-lighting LED chip 122 are used for simulating an outer flame of a flame. The up-lighting LED chip is disposed on the top edge of the PCB substrate 121 and emits light upward. In this way, an entire upper portion of the diffusion cover 11 can be lit up by only one LED chip. Compared with a manner in the related art in which one front-lighting LED chip is provided respectively on both sides of a PCB substrate, the quantity of LED chips is reduced, no dark shadow appears at the top of the flame, and light of the outer flame is soft rather than dazzling. The two mid-lighting LED chips 123 are configured to simulate an inner flame, and are respectively disposed on the front and back surfaces of the PCB substrate 121 and emit light toward the front surface of the diffusion cover 11. In this way, light and shadows have a relatively large projection area, thereby preventing an obvious light and shadow break from appearing on the diffusion cover 11. In addition, an illumination level of the simulated flame can be ensured, so that the simulated flame has both decorative and illumination functions. The down-lighting LED chip 124 is configured to simulate a flame core and emits light upward, which not only softens the light of the flame core, but also supplements light and shadows of a region that cannot be illuminated by the mid-lighting LED chips 123. In addition, there is the gap between the PCB substrate 121 of the narrow-edge section 1213 and the inner wall of the diffusion cover 11, which can not only avoid dark shadows on both sides of the diffusion cover 11 caused by light and shadows projected upward by the down-lighting LED chip 124 blocked by the both sides of the PCB substrate 121, thereby providing a better light supplementing effect of the down-lighting LED chip 124, but also reduce blocking of diffused light in the diffusion cover 11 by the PCB substrate 121 as much as possible and make light inside the diffusion cover 11 more uniform. Generally, the two mid-lighting LED chips 123 are both vertically disposed and are symmetrical with respect to a vertical central axis of the PCB substrate 121. In this case, the width of the narrow-edge section 1213 may be reduced as much as possible, and further, complete correspondence of positions of the two mid-lighting LED chips 123 on the front and back surfaces may be made. In this case, the width of the narrow-edge section 1213 may be reduced to the width of a single LED chip, to minimize blocking of light and shadows by the PCB substrate 121. The light-emitting lamp plate 12 enables an entire periphery of the diffusion cover 11 to simulate the light and shadow effect of flames.

An illumination level of the mid-lighting LED chip 123 is different from that of the up-lighting LED chip 122 and that of the down-lighting LED chip 124. In addition, each LED chip shades between brightness and darkness at random, which makes light and shadows at junctions change up and down, thereby simulating the dynamic effect of soft up-and-down waving of the inner flame part. The two mid-lighting LED chips 123 asynchronously shade between brightness and darkness, which can further simulate the dynamic effect of soft horizontal waving of the inner flame part, thereby simulating the dynamic effect of soothingly changing candle flames during burning. Compared with a manner of flickering lighting in the related art, the dynamic simulated effect is better.

The semi-transparent diffusion cover 11 can scatter and soften internal light, which can not only make light and shadows of the simulated flame more saturated and more uniform, and thus make light soft rather than dazzling, but also prevent an obvious bright spot from appearing at the position of each LED chip.

By using a small quantity of LED chips, the simulated flame device 1 can simulate a complete flame form that is close to the light and shadow level and dynamic burning effects of real flames, and has both decorative and illumination functions with low costs, low energy consumption, and a small volume. A smallest width of the accommodating cavity only needs to allow accommodation of a horizontal LED chip. Compared with the structure of a swaying flame sheet in the related art, the simulated flame device 1 can be made into a quite small volume, and thus is applicable to most products with a simulated flame, for example, being made into a small and thin candle.

Figure 7:
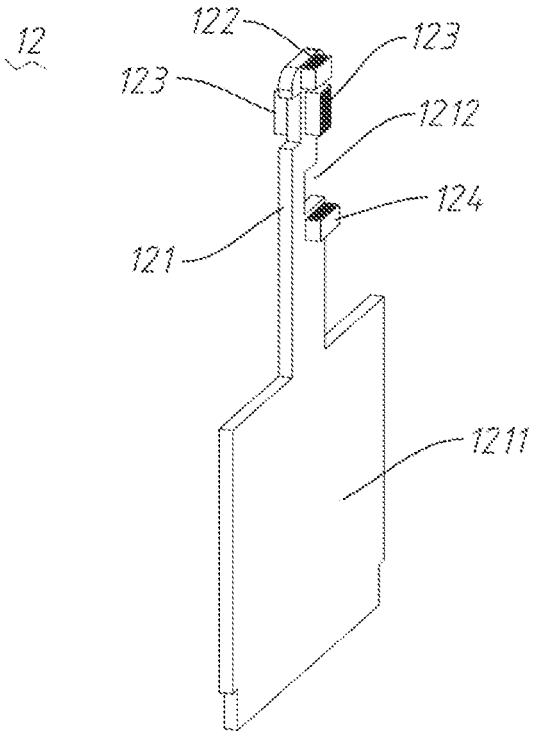
FIG. 7 is a schematic three-dimensional diagram of a first structure of a light-emitting lamp plate according to an embodiment.
Figure 8:
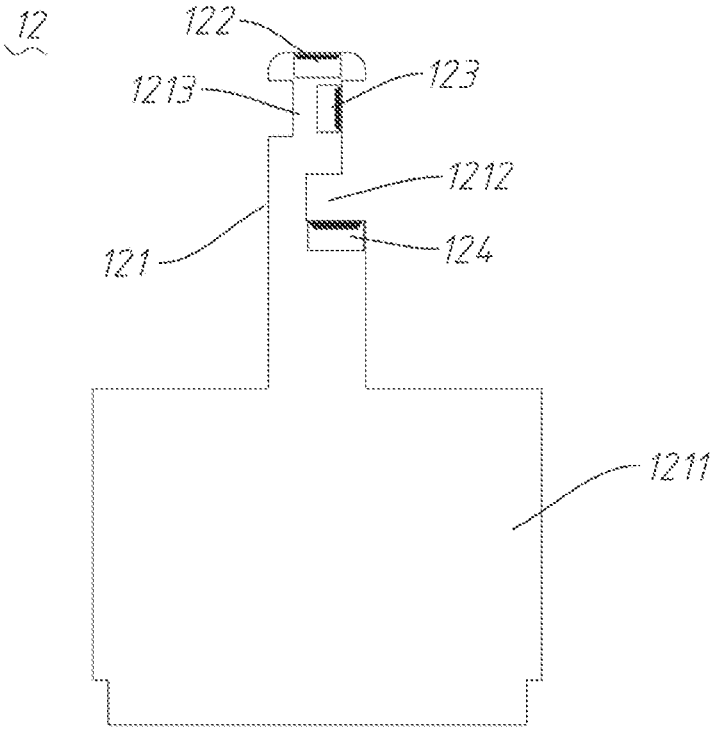
FIG. 8 is a schematic planar diagram of a second structure of a light-emitting lamp plate according to an embodiment.

Referring to FIG. 4, FIG. 7, and FIG. 8, in a preferable implementation structure of the down-lighting LED chip 124, there is only one down-lighting LED chip 124, and a position of the PCB substrate 121 corresponding to an upper part of a light-exiting surface of the down-lighting LED chip 124 is provided with a notch portion 1212 capable of projecting the light and shadows of the down-lighting LED chip 124 onto the other surface of the PCB substrate 121. One down-lighting LED chip 124 can provide light and shadows for a lower portion of the diffusion cover 11, and supplements light and shadows of the region at the middle portion of the diffusion cover 11 that cannot be illuminated by the mid-lighting LED chips 123. The quantity of LED chips required is small, and the costs and energy consumption are low. In addition, compared with using two or more down-lighting LED chips 124, the flame core part does not need to change synchronously to make the dynamic effect of light and shadows consistent. Therefore, scattered light and shadows do not appear at the flame core part, and the darker effect of the flame core part is ensured. In another embodiment, two or more down-lighting LED chips 124 may alternatively be provided on the front and back surfaces of the PCB substrate 121. However, the costs and energy consumption increase, and the brightness of the flame core part is also enhanced.

Referring to FIG. 8, in a preferable implementation structure of the mid-lighting LED chips 123, the two mid-lighting LED chips 123 are both vertically disposed side-lighting LED chips, and the two mid-lighting LED chips 123 are respectively disposed on two side edges of the narrow-edge section 1213 and light-exiting surfaces thereof are toward an outer side of the PCB substrate 121. The mid-lighting LED chips 123 are located on two side edges of the PCB substrate 121 and emit light toward the outer side of the PCB substrate 121. In this case, an edge of the narrow-edge section 1213 of the PCB substrate 121 does not block the mid-lighting LED chips 123 from emitting light toward the back. Therefore, the down-lighting LED chip 124 only needs to supplement light of a middle part of the front and back surfaces of the PCB substrate 121. In addition, the mid-lighting LED chips 123 are vertically disposed, which can increase the height of light and shadows at the inner flame part of the diffusion cover 11 and make the dynamic effect of the simulated flame more obvious. However, since the mid-lighting LED chips 123 are side-lighting LED chips in this case, a light-exiting area and light-exiting angle thereof are smaller compared with a front-lighting LED chip, which reduces an illumination level of the middle portion of the diffusion cover 11.

Referring to FIG. 4 and FIG. 7, in another preferable implementation structure of the mid-lighting LED chips 123, the two mid-lighting LED chips 123 are both vertically disposed front-lighting LED chips. Since the mid-lighting LED chips 123 are front-lighting LED chips, the light-exiting area and light-exiting angle thereof are larger, which can increase the coverage of light and shadows at the inner flame part. In addition, the mid-lighting LED chips 123 are vertically disposed, which can increase the height of light and shadows at the inner flame part, and make the light and shadow level and dynamic effects of the simulated flame more obvious. Furthermore, the both sides of the PCB substrate 121 can be made narrower, thereby reducing blocking of light supplemented by the down-lighting LED chip 124.

In a preferable implementation structure of the PCB substrate 121, the front and back surfaces of the PCB substrate 121 located in the accommodating cavity are both white reflective surfaces. The white reflective surfaces can enhance the reflective effect of light, making light and shadows inside the diffusion cover 11 more uniform.

In a preferable implementation structure, a color of the mid-lighting LED chip 123 is different from that of both the up-lighting LED chip 122 and the down-lighting LED chip 124. For example, the mid-lighting LED chips 123 are orange LED chips, while the up-lighting LED chip 122 and the down-lighting LED chip 124 are golden LED chips. In this way, the dynamic simulated effect of the middle portion of the diffusion cover 11 is more obvious, and light and shadows between the outer flame, the inner flame, and the flame core are of better sense of level, providing a better simulated effect.

Referring to FIG. 4, in a preferable implementation structure of the diffusion cover 11, the middle portion of the diffusion cover 11 corresponding to the mid-lighting LED chips 123 is an externally convex cambered surface 112, and the diffusion cover 11 is in a shape rotationally symmetrical around a vertical center line. The diffusion cover 11 makes the simulated flame device 1 more close to real flames in shape, and the cambered surface 112 makes the mid-lighting LED chips 123 relatively away from an outer surface of the diffusion cover 11. In this way, light emitted by the mid-lighting LED chips 123 from the front is refracted to be scattered and not dazzling. In addition, the outer surface is more away from the mid-lighting LED chips 123, so that light spots are not easily generated. In another embodiment, the diffusion cover 11 may alternatively be in another shape, for example, the tip bending toward one side, or the diffusion cover 11 being of a slightly flat structure in sagittal symmetry, or the like. When the diffusion cover 11 simulates different flame shapes, the overall light and shadow effect is not affected significantly.

Still further, a wall thickness of a middle lower portion of the diffusion cover 11 is greater than a wall thickness of the upper portion. For example, a maximum wall thickness of the middle lower portion of the diffusion cover 11 is approximately 2.5 mm, and the wall thickness of the upper portion is approximately 1.5 mm. A larger wall thickness of the middle lower portion can not only further fade the light spots and make light more uniform, but also make the light of the mid-lighting LED chips 123 softer and not dazzling.

The foregoing description is not construed as any limitation on the technical scope of the present invention, and any changes, equivalent variations, and modifications made to the foregoing embodiments without departing from the technical essence of the present invention shall fall within the scope of the technical solutions of the present invention.

What is claimed is:

1. A light-emitting diode (LED) simulated flame device, comprising:

a semi-transparent diffusion cover in a candle flame shape and having an accommodating cavity, a light-emitting lamp plate vertically inserted in the accommodating cavity, and a control circuit module for driving the light-emitting lamp plate to work;

wherein the light-emitting lamp plate comprises:

a printed circuit board (PCB) substrate, and a plurality of LED chips disposed on the PCB substrate and shading between brightness and darkness at random;

wherein the plurality of LED chips comprise only one up-lighting LED chip, only two mid-lighting LED chips, and only one down-lighting LED chip; wherein the up-lighting LED chip is located on a top edge of the PCB substrate, the up-lighting LED chip emits light upward, and the up-lighting LED chip is configured to project light and shadows onto a middle upper portion of the semi-transparent diffusion cover;

the two mid-lighting LED chips emit light toward a front surface of the semi-transparent diffusion cover, the two mid-lighting LED chips are configured to project light and shadows onto a middle portion of the semi-transparent diffusion cover, and the two mid-lighting LED chips are located on front and back surfaces of the PCB substrate; and the at least one down-lighting LED chip corresponds to a bottom portion of the semi-transparent diffusion cover, the at least one down-lighting LED chip emits light upward, and the at least one down-lighting LED chip is configured to supplement light;

wherein a section of the PCB substrate corresponding to the two mid-lighting LED chips is a narrow-edge section with a gap from an inner wall of the semi-transparent diffusion cover to reduce light shading;

only one down-lighting LED chip is arranged, and a position of the PCB substrate corresponding to the above of a light-exiting surface of the down-lighting LED chip is provided with a notch portion, wherein the notch portion is configured to project light of the down-lighting LED chip onto the other surface of the PCB substrate.

2. The LED simulated flame device according to claim 1, wherein the two mid-lighting LED chips are vertically disposed side-lighting LED chips, the two mid-lighting LED chips are respectively disposed on two side edges of the narrow-edge section, and light-exiting surfaces of the two mid-lighting LED chips are toward an outer side of the PCB substrate.

3. The LED simulated flame device according to claim 1, wherein the two mid-lighting LED chips are vertically disposed front-lighting LED chips.

4. The LED simulated flame device according to claim 1, wherein the front and back surfaces of the PCB substrate located in the accommodating cavity are white reflective surfaces.

5. The LED simulated flame device according to claim 1, wherein a color of each of the two mid-lighting LED chips is different from a color of the up-lighting LED chip and a color of the down-lighting LED chip.

6. The LED simulated flame device according to claim 1, wherein the middle portion of the semi-transparent diffusion cover corresponding to the two mid-lighting LED chips is an externally convex cambered surface, and the semi-transparent diffusion cover is in a shape rotationally symmetrical around a vertical center line.

7. The LED simulated flame device according to claim 6, wherein a wall thickness of a middle lower portion of the semi-transparent diffusion cover is greater than a wall thickness of an upper portion of the semi-transparent diffusion cover.

8. An LED simulated candle, comprising:

the LED simulated flame device according to claim 1, a hollow simulated wax tube, and a battery holder mounted on the hollow simulated wax tube and configured to mount a battery;

wherein the battery holder is electrically connected to the PCB substrate.

9. The LED simulated candle according to claim 8, wherein only one down-lighting LED chip is arranged, and a position of the PCB substrate corresponding to the above of a light-exiting surface of the down-lighting LED chip is provided with a notch portion, wherein the notch portion is configured to project light of the down-lighting LED chip onto the other surface of the PCB substrate.

10. The LED simulated candle according to claim 8, wherein the two mid-lighting LED chips are vertically disposed side-lighting LED chips, the two mid-lighting LED chips are respectively disposed on two side edges of the narrow-edge section, and light-exiting surfaces of the two mid-lighting LED chips are toward an outer side of the PCB substrate.

11. The LED simulated candle according to claim 8, wherein the two mid-lighting LED chips are vertically disposed front-lighting LED chips.

12. The LED simulated candle according to claim 8, wherein the front and back surfaces of the PCB substrate located in the accommodating cavity are white reflective surfaces; and a bottom end of the semi-transparent diffusion cover is provided with a concentric base, the concentric base is provided with a cavity in communication with the accommodating cavity, two snap structures are provided in a bottom of the concentric base; the PCB substrate is provided with an extension plate, the extension plate is provided with a step structure to snap with the two snap structures to fix in the cavity of the concentric base, and the control circuit module is disposed on the extension plate.

13. The LED simulated candle according to claim 8, wherein a color of each of the two mid-lighting LED chips is different from a color of the up-lighting LED chip and a color of the down-lighting LED chip.

14. The LED simulated candle according to claim 8, wherein the middle portion of the semi-transparent diffusion cover corresponding to the two mid-lighting LED chips is an externally convex cambered surface, and the semi-transparent diffusion cover is in a shape rotationally symmetrical around a vertical center line.

15. The LED simulated candle according to claim 14, wherein a wall thickness of a middle lower portion of the semi-transparent diffusion cover is greater than a wall thickness of an upper portion of the semi-transparent diffusion cover.

* * * * *